US005600913A

United States Patent [19]

Minneman

[11] Patent Number: 5,600,913

[45] Date of Patent: Feb. 11, 1997

[54] PISTOL REST

[76] Inventor: Steven W. Minneman, c/o MTM Molded Products Company, 3370 Obco Ct., Dayton, Ohio 45414

[21] Appl. No.: 405,586

[22] Filed: Mar. 17, 1995

Related U.S. Application Data

[63] Continuation-in-part of Ser. No. 33,962, Jan. 24, 1995.

[51] Int. Cl.[6] ..... F41A 23/06

[52] U.S. Cl. ..... 42/94; 211/64; 248/125.3

[58] Field of Search ..... 42/94; 211/64; 248/118.3, 118.1, 125.1, 125.3

[56] References Cited

U.S. PATENT DOCUMENTS

| | | | |
|---|---|---|---|
| 185,004 | 12/1876 | White | 248/125.3 |
| D. 276,668 | 12/1984 | Minneman | D3/7 |
| D. 314,273 | 2/1991 | Minneman | D3/38 |
| 1,631,209 | 3/1926 | Jewell | 248/125.3 |
| 1,890,423 | 12/1932 | Teagarden | 42/94 |
| 3,012,350 | 12/1961 | Wold | 42/94 |
| 3,291,317 | 12/1966 | Bowen | 211/64 |
| 3,608,225 | 9/1971 | Manuel | 42/94 |
| 3,807,466 | 4/1974 | Minneman | 141/332 |
| 3,876,079 | 4/1975 | Elkins et al. | 211/64 |
| 3,913,746 | 10/1975 | Burton | 211/64 |
| 3,923,152 | 12/1975 | Minneman | 206/3 |
| 3,931,893 | 1/1976 | Elkins et al. | 211/64 |
| 4,058,221 | 11/1977 | Elkins et al. | 211/87 |
| 4,194,657 | 3/1980 | Thor | 224/252 |
| 4,207,699 | 6/1980 | Hensley | 42/94 |
| 4,232,919 | 11/1980 | Stewart | 312/254 |
| 4,467,947 | 8/1984 | Minneman | 224/253 |
| 4,481,964 | 11/1984 | Minneman | 135/66 |
| 4,702,029 | 10/1987 | DeVaul et al. | 42/94 |
| 4,776,471 | 10/1988 | Elkins | 211/64 |
| 5,149,900 | 9/1992 | Buck | 42/94 |
| 5,414,949 | 5/1995 | Peebles | 42/94 |

OTHER PUBLICATIONS

MTM Case–Gard, Catalog #82, undated.
MTM Case–Gard, Catalog 1990.
MTM Case–Gard, Catalog 1992.
MTM Case–Gard, Catalog 1994.

*Primary Examiner*—Michael J. Carone
*Assistant Examiner*—Christopher K. Montgomery
*Attorney, Agent, or Firm*—Jacox, Meckstroth & Jenkins

[57] ABSTRACT

A two-piece adjustable molded plastic pistol rest which permits a fork member to be retained within a base member to facilitate storage of the pistol rest. The pistol rest includes a base member and a detachable fork weber engaged with the base member. The base member has a front surface which defines a center channel and two outer channels. The outer channels are positioned on either side of the center channel, and the center channel includes a number of spaced-apart interior guide ribs. The fork member includes an upright body and two forks extending divergently from the upright body. The upright body has a plurality of spaced-apart exterior guide ribs which mesh with the interior guide ribs to confine the fork member to one of a plurality of upright positions relative to the base member. The upright body also includes two guide arms that extend within the outer channels in the assembled state of the pistol rest. Each guide arm has a barbed free end which positively engages a locking tab associated with each outer channel to lock the fork member to the base member.

16 Claims, 7 Drawing Sheets

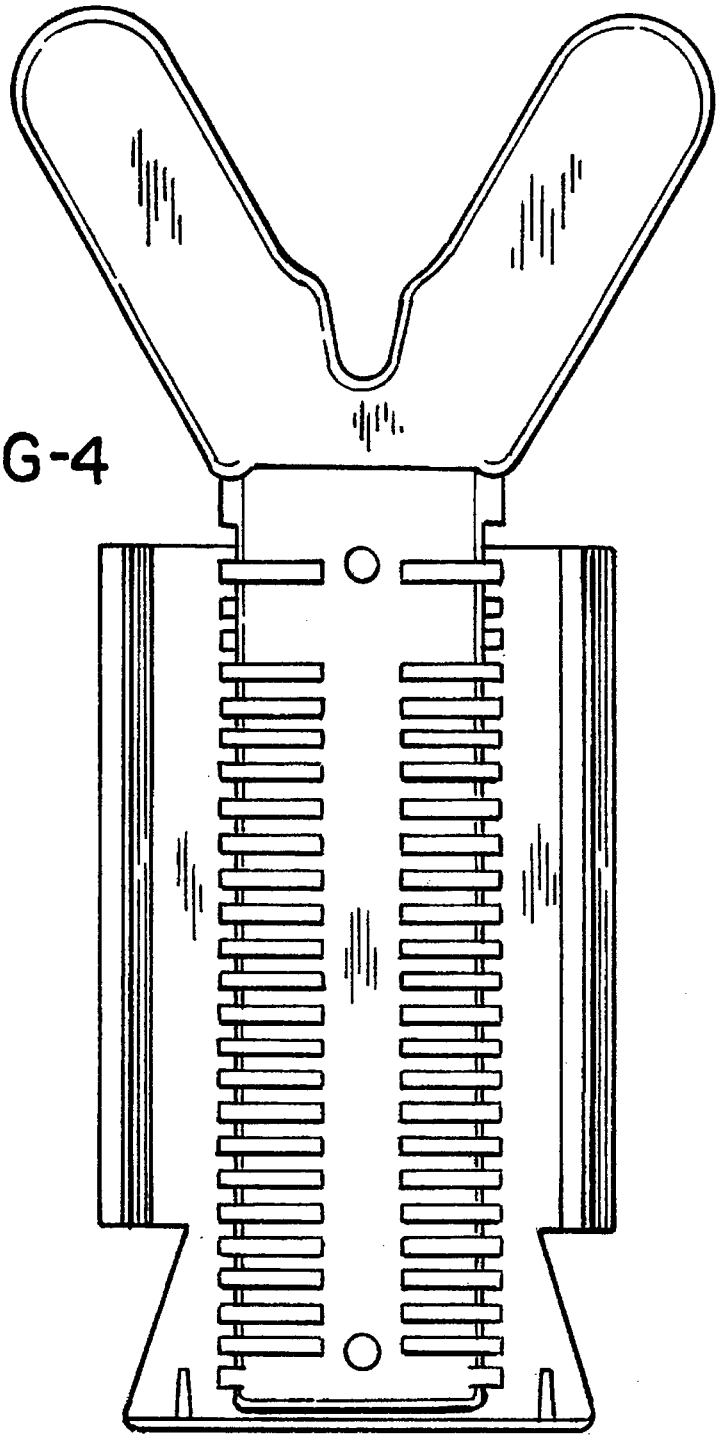
FIG-4
FIG-5
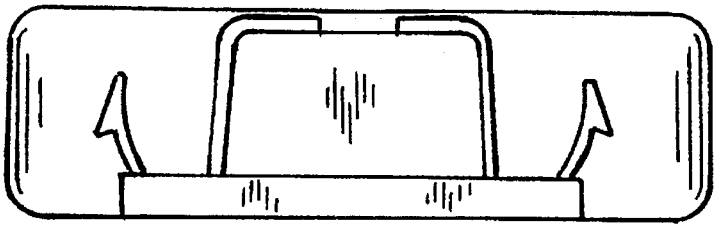

PISTOL REST

CROSS REFERENCE TO RELATED APPLICATIONS

The present patent application is a continuation-in-part of related co-pending design patent application Ser. No. 29/033,962, filed Jan. 24, 1995, pending.

BACKGROUND OF THE INVENTION

1. Field of the Invention

This invention relates to pistol rests, and more particularly, it relates to a two-piece plastic pistol rest which permits a fork member to be removably locked to a base member in one of a plurality of upright positions relative to the base member, and removably locked to the base member in a storage configuration.

2. Description of Related Art

A pistol rest is a device which facilitates the use of a firearm such as a handgun by providing a stable surface for supporting a handgun barrel during target practice, marksmanship competitions, hunting, and the like.

In use, the handgun barrel is supported by surface defined by two divergent fork arms of a fork, member. Additionally, pistol rests commonly provide a base member for either directly supporting a pistol grip of the handgun, or for supporting a user's hand(s) while holding the pistol grip. Typically, padding material provided on the base member to absorb impacting forces that are created during use of the pistol rest.

With all of the various shapes and sizes of handguns available, it is desirable to provide an adjustable pistol rest which permits a user to select an optimum configuration for properly supporting the particular size and shape of handgun to be used. That is, it is desirable to provide a pistol rest which permits the height of the fork arms to be adjusted relative to the base member to compensate for different types of handguns.

Further, it is desirable to provide a light-weight and portable pistol rest which can be broken down into a storage configuration to facilitate the transportation and storage of the pistol rest when not in use.

What is needed therefore is a pistol rest which permits a fork member to be removably locked to a base member in one of a plurality of upright positions relative to the base member, and removably locked to the base member in a storage configuration.

SUMMARY OF THE INVENTION

Thus, it is a primary object of this invention to provide an adjustable pistol rest which permits a fork member to be removably locked to a base member in one of a plurality of upright positions relative to the base member without the use of tools.

It is another object of this invention to provide a light-weight, reconfigurable pistol rest which permits a fork member to be removably locked to a base member in a storage configuration without the use of tools.

It is yet another object of this invention to provide a two-piece pistol rest molded from a plastic material which allows the pistol rest to resiliently flex in response to shocks or impacting forces that occur during use thus eliminating the need for padding material on the base member.

It is yet another object of this invention to provide a pistol rest which is simple and quick to manufacture thus increasing production efficiency.

In one aspect of the invention, a pistol rest is provided which includes a base member and a detachable fork member which is lockingly secured to the base member for supporting a gun barrel.

In another aspect of the invention, a pistol rest is provided which includes a base member, a detachable fork member for supporting a gun barrel wherein the fork member engages the base member in one of a number of upright positions relative to the base member, an arrangement for confining the fork member to one of the upright positions, and an arrangement for locking the fork member to the base member.

In still another aspect of the invention, a pistol rest is provided which includes a base member having a front surface defining a forwardly opening center channel and two forwardly opening outer channels. The outer channels are positioned on either side of the center channel and the center channel has a number of spaced-apart interior guide ribs, and the outer channels each have a locking tab associated therewith. A detachable fork member is engaged with the base member and includes an upright body defining a forwardly opening channel and two fork arms extending divergently from the upright body. The upright body includes a number of spaced-apart exterior guide ribs meshed with the interior guide ribs to confine the fork member to one of a plurality of upright positions relative to the base member. The upright body also includes two guide arms extending within the outer channels respectively from the upright body, wherein the guide arms each have a barbed free end which positively engages the respective locking tab to lock the fork member to the base member.

These and other objects and advantages of the invention will be apparent from the following description, the accompanying drawings and the appended claims.

BRIEF DESCRIPTION OF THE DRAWINGS

FIG. 4 is a rear elevational view of a fork member of the pistol rest shown in FIG. 1;

FIG. 5 is a bottom plan view of the fork member shown in FIG. 4;

DETAILED DESCRIPTION OF THE PREFERRED EMBODIMENT

Figure 1:
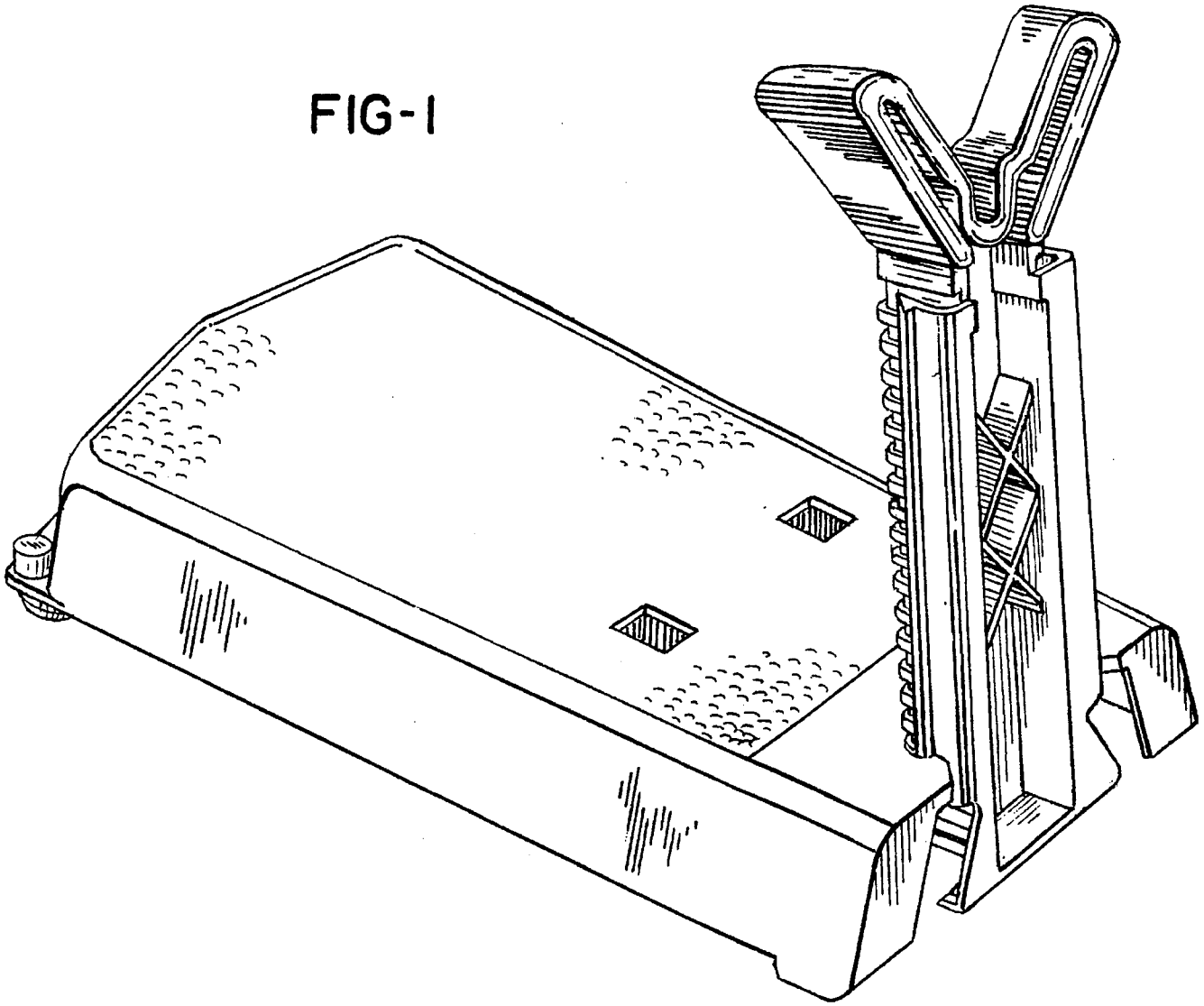
FIG. 1 is a perspective view of the pistol rest of the present invention.

Referring now to FIG. 1, there is shown a preferred embodiment for a pistol rest 10 of the present invention. The pistol rest 10 includes a base member 12 and a removable fork or support member 14 which adjustably interlocks with the base member 10 to permit a user to select an optimum configuration of the pistol rest. That is, the fork member 14 can be adjusted relative to the base member 12 in any one of a plurality of upright positions as discussed further below.

Figure 2:
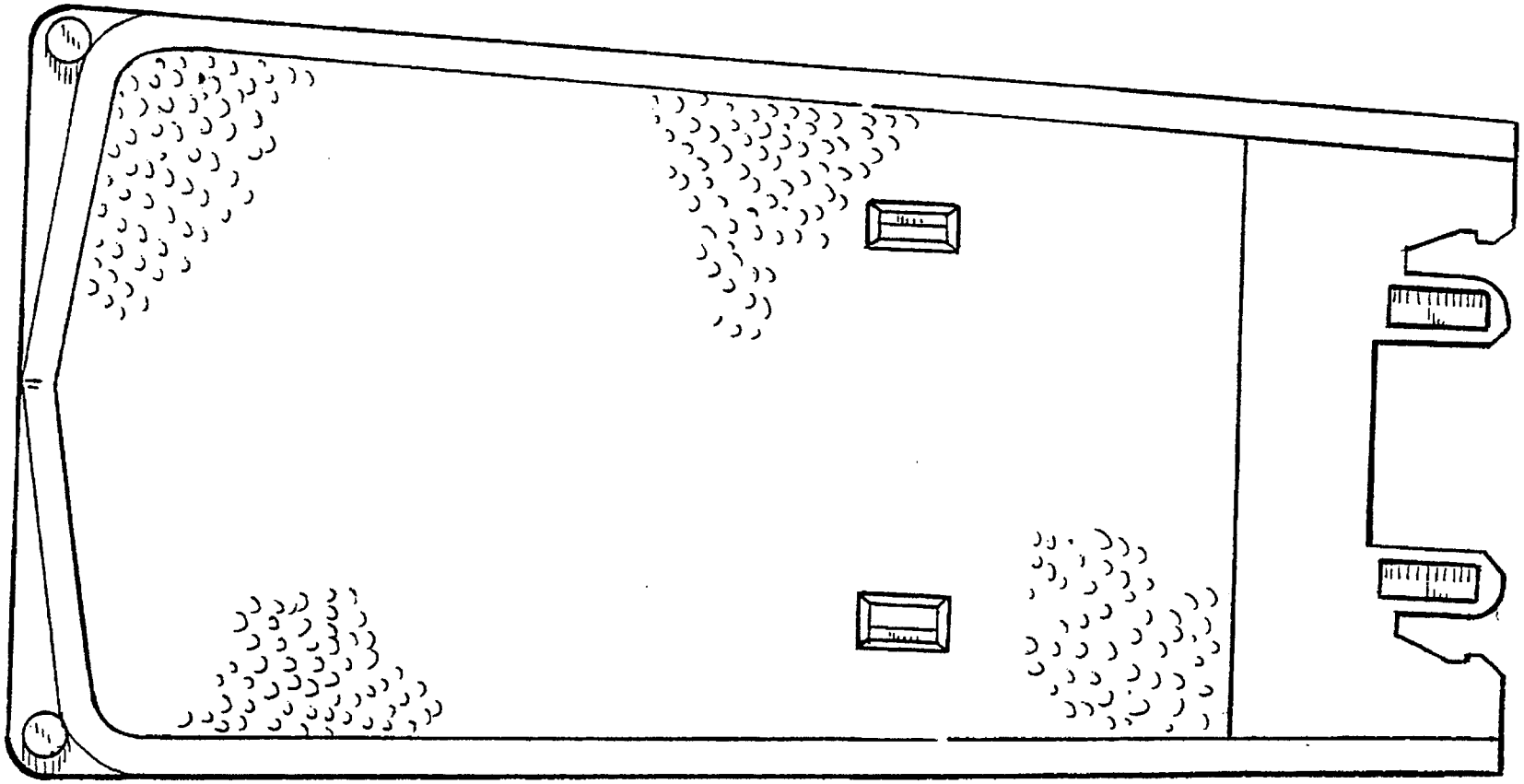
FIG. 2 is a top plan view of a base member of the pistol rest shown in FIG. 1.
Figure 3:
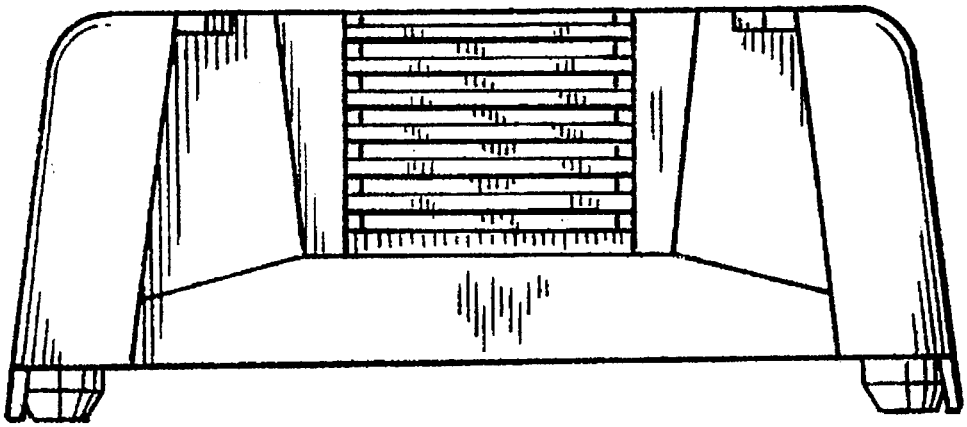
FIG. 3 is a front elevational view of the base member shown in FIG. 2.

As seen in FIGS. 1–3, the base member 10 includes a planar top surface 18 for supporting a pistol grip of a hand gun and/or a user's hand(s) while holding the pistol grip. In the described embodiment, at least a portion of the top surface 18 includes a bubble grained texture to enhance the ability of the base member 12 to frictionally support the pistol grip or the user's hand(s). Two side surfaces 20, 22 extend transversely from opposite side edges of the top surface 18. Likewise, a front surface 26 and rear surface 28 extend transversely from opposite front and rear edges, respectively, of the top surface 18. The top, side, front and rear surfaces of the base member 10 cooperate to define a downwardly opening cavity 30 for storing the fork member 14 as discussed further below.

As best seen in FIG. 2, the front surface 26 includes a forwardly opening contoured recess or mating portion 34 having two parallel spaced-apart walls 36, 38 centrally positioned within the recess 34 which extend forwardly from a rear wall 42 of the recess 34. The walls 36, 38 slightly diverge in a direction away from the rear wall 42 to divide the recess 34 into a vertically oriented center channel 44 and two vertically oriented outer channels 46, 48.

As best seen in FIG. 3, a plurality of vertically spaced-apart interior guide ribs or receptors 52 line the interior of the center channel 44. That is, the ribs 52 extend from mutually opposing interior surfaces 54 of the walls 36, 38 and from the rear wall 42. The ribs 52 are substantially planar and cooperate with the fork member 14 to confine the fork member 14 to the base member 12 in one of a plurality of upright positions in an assembled state of the pistol rest 10. In the described embodiment of the pistol rest 10, there are approximately six spaced-apart ribs lining the interior of the center channel 44.

The center channel 44 is strengthened or braced by a plurality of interconnecting support walls 56 within the cavity 30 (FIG. 6) which extend from the top surface 18 and side surfaces 20, 22 to the rear wall 42 of the recess 34. A plurality of mutually opposing retaining tabs 57 extend from the support walls 56. The retaining tabs 57 resist relative movement between the fork member 14 and the base member 12 when in a storage configuration of the pistol rest 10 as discussed further below.

As seen in FIG. 2, the outer channels 46, 48 each include a locking tab 58 integrally formed on respective side walls 60 of the recess 34. The locking tabs 58 cooperate with the fork member 14 to lockingly secure the fork member 14 to the base member 12 in an assembled state of the pistol rest 10.

Figure 6:
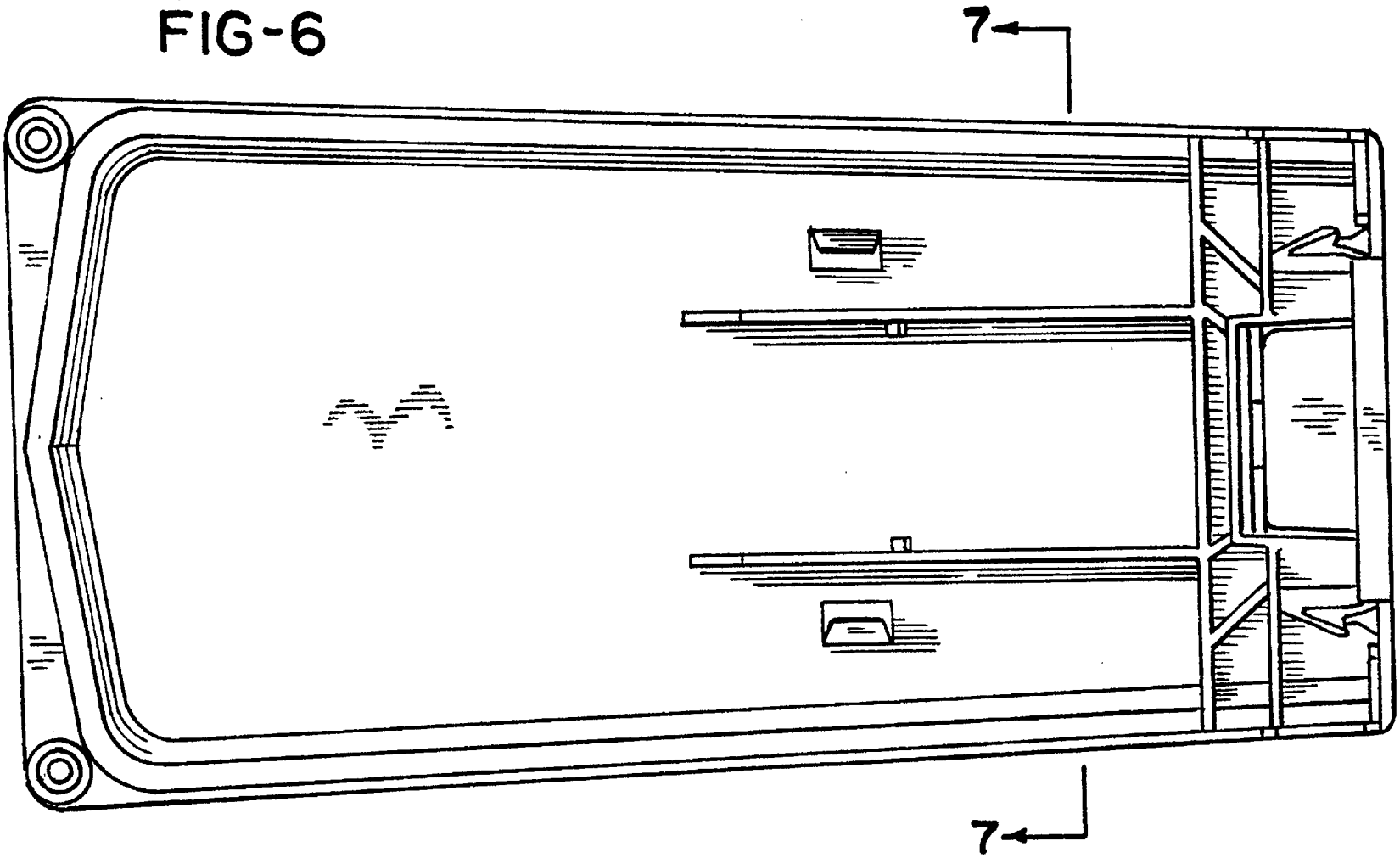
FIG. 6 is a bottom plan view of the pistol rest shown in FIG. 1.

Referring to FIGS. 2 and 6, the base member 10 also includes a flanged portion 62 extending rearwardly from a lower end edge of the rear surface 28. The flanged portion 62 provides a mounting surface for attaching a plurality of non-slip rear pads 66 thereto. Likewise, a front leg 68 is formed integrally with, and extends downwardly from the lower front edge of each side surface 20, 22. With the rear pads 66 installed, the front legs 68 serve to level the base member 12 so that the lower end edges of the side walls 20, 22, front wall 26 and rear wall 28 are evenly spaced above a planar resting surface. With the lower end edges elevated, the base member 12 can effectively absorb shocks or impacting forces by resiliently flexing in response thereto, thus eliminating the need for adding padding material to the base member 12.

Figure 7:
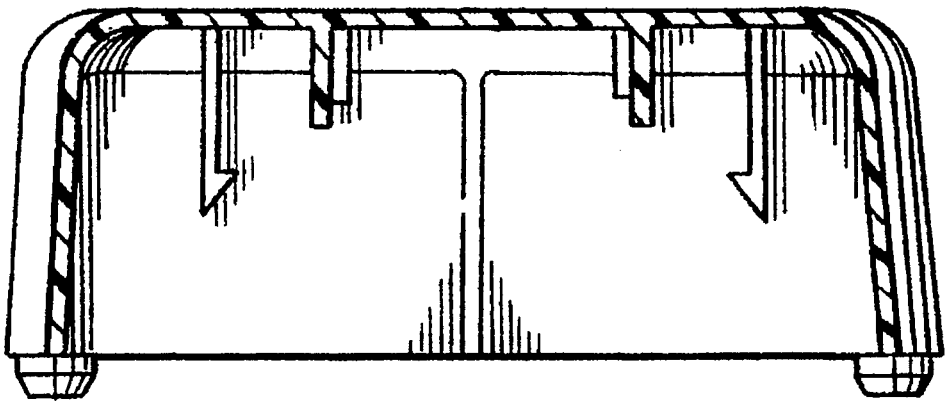
FIG. 7 is a sectional view of the base member taken along the line 7—7 of FIG. 6.

As best seen in FIG. 7, a pair of locking clips 70 extend downwardly within the cavity 30 from the top surface 18. The locking clips 70 provide means for storing or lockingly retaining the fork member 14 within the cavity 30 in the storage configuration of the pistol rest 10. Two apertures or holes 74 extend through the top surface 18 adjacent the locking clips 70. The apertures permit barbs 76 to be formed on the lower free ends of the locking clips without having to overmold the base member 10 during the manufacturing process.

As shown in FIGS. 4 and 5, the fork member 14 includes an upright body 78 having two fork arms 82 divergently extending from an upper end of the upright body 78. The upright body 78 also includes a rear wall 84, a lower end wall 85, and two side walls 86, 88 which cooperate to form a forwardly opening channel or mating portion 89 that substantially conforms to the shape and dimensions of the center channel 44. The side walls 86, 88 slightly diverge in a direction away from the rear wall 84 to substantially conform to the slightly divergent walls 36, 38 which define the center channel 44. The divergent walls 36, 38 and 86, 88 cooperate to permit the fork member 14 to easily break free from the base member 12 when separating the fork member 14 from the base member 12.

A plurality of support walls 91 (FIG. 1) are disposed within the channel 89. The support walls 91 join the side walls 86, 88 and the rear wall 84 of the upright body 78 together to reinforce the fork member 14.

Referring to FIG. 4, a plurality of spaced-apart exterior guide ribs or positioners 90 line the exterior surfaces of the rear wall 84 and side walls 86, 88. The ribs 90 are substantially planar and cooperate with the ribs 52 of base member 12 to not only rigidly join the fork member 14 to the base member 12, but also to confine the fork member 14 to one of a plurality of upright positions relative to the base member 12 in an assembled state of the pistol rest 10. That is, a plurality of the ribs 90 mesh with the ribs 52 in an assembled state of the pistol rest 10. In the described embodiment, there are approximately twenty-five spaced-apart ribs 90 lining the exterior surfaces of the upright body 78 which provide approximately 20 different upright positions for the fork member 14.

The fork arms 82 cooperate to form a contoured interior surface 92 to which a conforming resilient padding 94 is molded, or otherwise secured thereto. The padding 94 is preferably molded from a synthetic rubber compound conventionally known in the art. It should be appreciated that a gun barrel (not shown) is supported by the contoured interior surface 92, and that the distance separating the top surface 18 from the contoured interior surface 92 varies depending upon which upright fork position is selected.

As best seen in FIGS. 4 and 5, a pair of cantilevered locking arms or members 96 extend laterally outwardly and rearwardly from the forward edges of the side walls 86, 88, respectively. The locking arms 96 each include a rearwardly projecting barbed free end 98 which is spaced apart-from, and which extends along, the respective side wall 86, 88. The barbed free ends 98 cooperate with the locking tabs 58 of the base member 12 to lockingly retain the fork member 14 to the base member 12 in an assembled state of the pistol rest 10.

In addition, a skirt portion 100 extends laterally from the forward side edges of the side walls 86, 88 and lower end wall 85. A flanged foot 102 extends transversely from lower end edge of the skirt portion 100. The flanged foot 102 contacts a resting surface (not shown) to support the pistol rest 10 in a plurality of upright fork member positions discussed below.

The base member 12 and fork member 14 are preferably injection molded from a plastic material such as polypropylene or polyethylene. The plastic material permits base member 12 to exhibit flexibility or resiliency characteristics that eliminate the need for providing padding material as discussed above. Further, the plastic material provides an extremely lightweight pistol rest weighing less than one pound.

The pistol rest 10 is assembled by joining the fork member 14 to the base member 12 in the following manner. The ribs 90 of the fork member 14 are initially aligned with the mutually conforming ribs 52 of the center channel 44. The ribs 52 and 90 cooperate to guide the barbed free ends 98 of the cantilevered locking arms 96 into abutting contact with the forward ends of the locking tabs 58 as the fork member 14 is urged rearwardly.

Further rearward movement of the fork member 14 causes the locking tabs 58 to urge the barbed free ends 98 resiliently inwardly in a direction toward the upright body 78. When the rear wall 84 of the upright body 78 is proximate the rear wall 42 of the contoured recess 34, the barbed free ends 98 clear the locking tabs 58 and resiliently return outwardly into abutment with the side walls 60 of the contoured recess 34.

The barbed free ends 98 will abut the locking tabs 58 of the base member 12 to lockingly retain the fork member 14 to the base member 12 to resist forward movement of the fork member 14 relative to the base member 12. Thus, the fork member 14 remains lockingly retained to the base member 12 at a substantially upright orientation relative to the base member 12.

It should be appreciated that, in an assembled state of the pistol rest 10, the fork member 14 can be secured to the base member 12 in any one of a plurality of substantially upright positions relative to the base member 12 depending upon which plurality of fork member ribs 90 the user selects to mesh with the ribs 52 of the base member 12. That is, the fork member 14 will remain at a substantially upright orientation relative to the base member 12 in any one of the substantially upright positions enumerated below. This permits a user to select an optimum configuration of the pistol rest 10 to suit the needs of the user.

In an uppermost position of the fork member 14 relative to the base member 12, the base member 12 rests upon the pads 66 and front legs 68, and the lower end wall 85 of the upright body 78 is spaced upwardly apart-from a resting surface (not shown) upon which the pistol rest 10 is placed.

The fork member 14 can be adjustably lowered from the uppermost position approximately five rib positions relative to the base member 12 before the flanged foot 102 contacts the surface upon which the pistol rest 10 is placed. That is, the position of the fork member 14 relative to the base member 12 changes while the position of the base member 12 relative to the resting surface remains constant as shown in FIG. 1.

Figure 8:
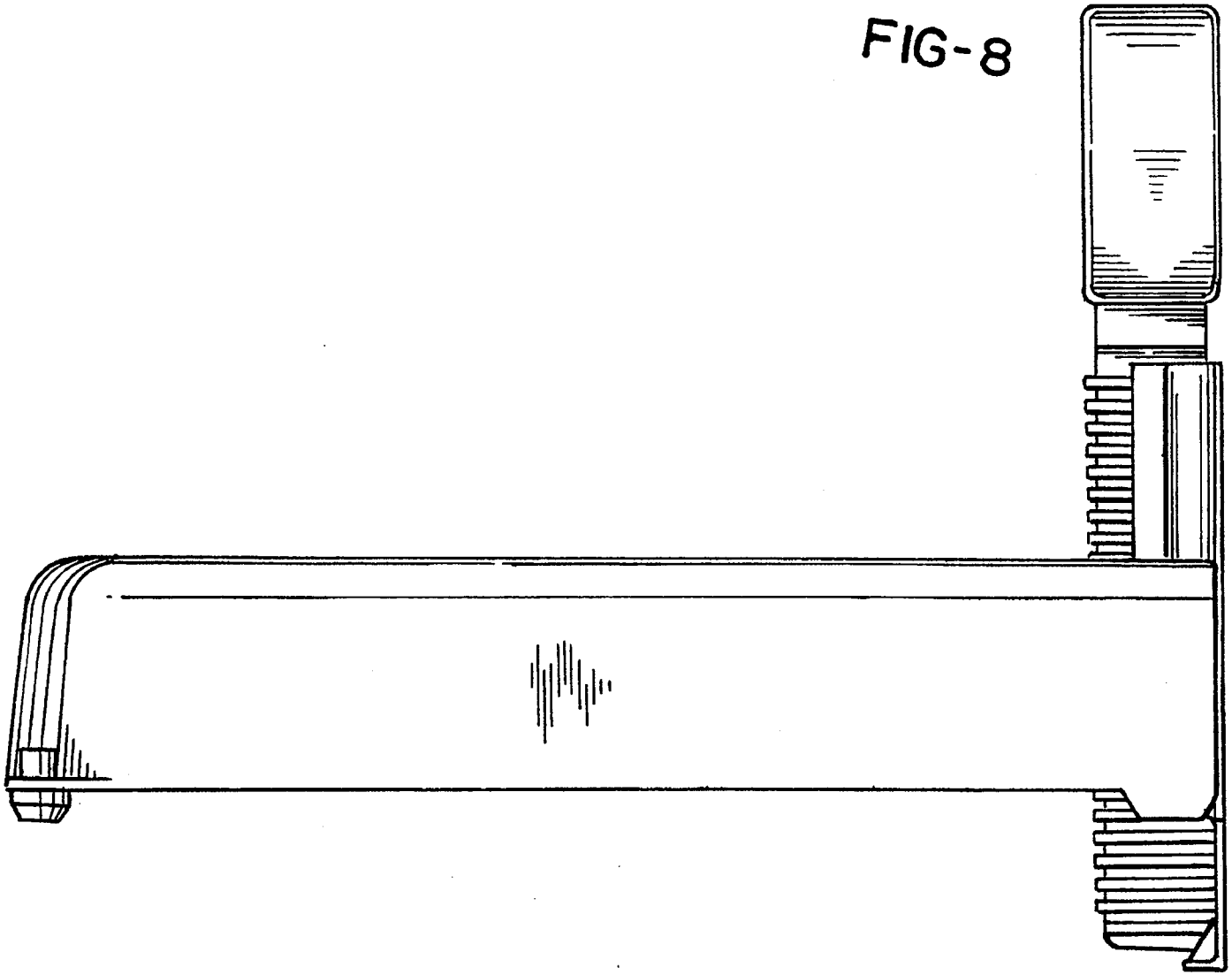
FIG. 8 is an elevational view of the pistol rest showing one of a plurality of orientations of the fork member relative to the base member.

When the fork member 14 is adjustably lowered more than five rib positions from the uppermost position, then the orientation of the fork member 14 relative to the base member 12 changes, and the orientation of the base member 12 relative to the resting surface also changes. That is, the flanged foot 102 extends below the front legs 68 to directly support the front of the pistol rest 10, and the base member 12 is angled upwardly relative to the resting surface such that the front legs 68 no longer contact the resting surface as shown in FIG. 8.

As the fork member 14 is lowered further to a lowermost position relative to the base member 12, the angle of the base member 12 relative to the resting surface increases and the fork member 14 pivots relative to the resting surface about the lower end wall 85.

To disengage the fork member 14 from the base member 12, the barbed free ends 98 must be manually urged or squeezed sufficiently inwardly in a direction toward the upright body 78 so as to clear the locking tabs 58. Once the barbed free ends 98 have cleared the locking tabs 58, the fork member 14 is urged sufficiently forwardly relative to the base member 12 until the fork member 14 is disengaged from the base member 12.

Figure 9:
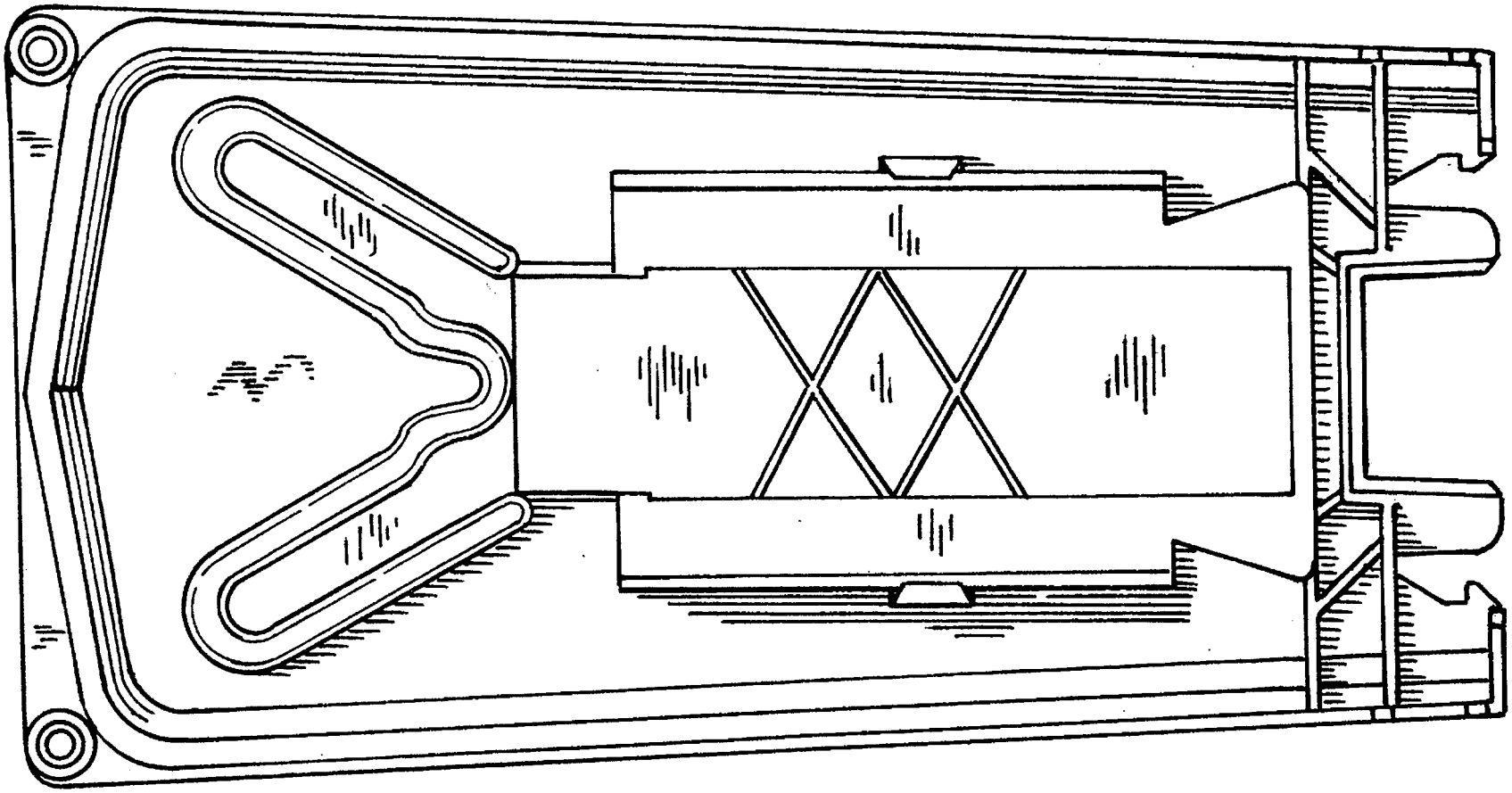
FIG. 9 is a bottom plan view of the pistol rest showing the fork member in a storage configuration within the base member.

As shown in FIG. 9, after the fork member 14 is disengaged from the base member 12, the fork member 14 can be secured within the cavity 30 of the base member 12 in a storage configuration of the pistol rest 10. In the storage configuration, the fork member 14 is placed within the cavity 30 such that the barbed free ends 98 of the locking arms 96 extend toward the top surface 18 of the base member 12. As the barbed free ends 98 are urged into contact with the locking clip barbs 76, the locking clip barbs 76 are forced resiliently outwardly to permit the barbed free ends 98 to pass thereby.

The support walls 56 of the base member 12 are spaced sufficiently apart to permit the upright body 78 to fit therebetween. When the fork member 14 is inserted between the support walls 56, the retaining tabs 57 mesh with the ribs 90 extending from the side walls 86, 88 of the fork member 14 to prevent the fork member 14 from sliding or moving within the cavity 30 relative to the base member 12.

The locking clip barbs 76 retain the fork member 14 within the cavity 30 by abutting with the barbed free ends 98 after the barbed free ends 98 have passed by the locking clip barbs 76 and the locking clip barbs 76 have resiliently move into position over the barbed free ends 98. To remove the fork member 14 from the cavity 30, the locking clips 70 are manually spread-apart until the fork member 14 is free from the locking clip barbs 76.

While the forms of the device herein described constitute the preferred embodiments of the invention, it is to be understood that the invention is not limited to these precise forms of device, and that changes may be make therein without departing from the scope of the invention which is defined in the appended claims.

For instance, it should be appreciated that guns other than hand guns can be used with the above described pistol rest 10, such as rifles and shotguns. Further, a sandbag, or the like, could be placed over the top surface 18 of the base member 12 during use in order to further stabilize the fork member 14.

What is claimed is:

1. A pistol rest comprising:

a base member; and a detachable fork member lockingly secured to said base member for supporting a gun barrel;

said detachable fork member being unlocked when at least a portion of said fork member is squeezed to permit said fork member to be adjusted relative to said base member;

said base member including a center channel for slidably receiving said detachable fork member.

2. The pistol rest claimed in claim 1, wherein said base member further includes at least one outer channel for receiving a locking arm associated with said fork member.

3. The pistol rest claimed in claim 2, wherein said base member further includes two spaced-apart forwardly extending walls which cooperate to define said center channel and said at least one outer channel.

4. The pistol rest claimed in claim 2, wherein said base member further includes a locking tab associated with said at least one outer channel for cooperating with said locking arm.

5. The pistol rest claimed in claim 4, wherein said locking arm includes a barbed free end for engaging with said locking tab to lock said fork member to said base member.

6. A pistol rest comprising:

a base member; and a detachable fork member lockingly secured to said base member for supporting a gun barrel;

said detachable fork member being unlocked when at least a portion of said fork member is squeezed to permit said fork member to be adjusted relative to said base member;

said base member further comprising a first plurality of guide ribs and said detachable member further comprising a second plurality of guide ribs which cooperate to confine said fork member to one of a plurality of upright positions relative to said base member.

7. A pistol rest comprising:

a base member;

a detachable fork member for supporting a gun barrel, said fork member engaging said base member in one of a plurality of upright positions relative to said base member;

means for confining said fork detachable member to said one of said plurality of upright positions; and means for locking said fork detachable member to said base member such that when said means for locking is squeezed, said detachable fork member becomes unlocked relative to said base member;

said means for confining includes a center channel associated with said base member for receiving said fork member;

said center channel including a plurality of guide ribs for meshing with said fork member.

8. A pistol rest comprising:

a base member;

a detachable fork member for supporting a gun barrel, said fork member engaging said base member in one of a plurality of upright positions relative to said base member;

means for confining said fork member to said one of said plurality of upright positions; and means for locking said fork member to said base member such that when said means for locking is squeezed, said detachable fork member becomes unlocked relative to said base member;

said means for confining includes a plurality of guide ribs associated with said fork member for meshing with said base member.

9. A pistol rest comprising:

a base member;

a detachable fork member for supporting a gun barrel, said fork member engaging said base member in one of a plurality of upright positions relative to said base member;

means for confining said fork member to said one of said plurality of upright positions; and means for locking said fork member to said base member such that when said means for locking is squeezed, said detachable fork member becomes unlocked relative to said base member;

said means for locking includes at least one outer channel associated with said base member for receiving said fork member.

10. The pistol rest claimed in claim 9, wherein said outer channel includes a locking tab associated therewith for interlocking with said fork member.

11. A pistol rest comprising:

a base member having a front surface defining a forwardly opening center channel and two forwardly opening outer channels, said outer channels being positioned on either side of said center channel, said center channel having a plurality of spaced-apart interior guide ribs, and said outer channels each having a locking tab associated therewith; and a detachable fork member engaged with said base member, said fork member having an upright body defining a forwardly opening channel and two fork arms extending divergently from said upright body, said upright body including a plurality of spaced-apart exterior guide ribs meshed with said interior guide ribs to confine said fork member to one of a plurality of upright positions relative to said base member, said upright body also including two guide arms extending within said outer channels respectively from said upright body, said guide arms having barbed free ends which positively engage said locking tabs to lock said fork member to said base member.

12. The pistol rest claimed in claim 11, wherein said base member and said fork member are molded from a plastic material.

13. A gun rest comprising:

a base member having a first mating portion;

a support member having a second mating portion which mates with said first mating portion to secure said support member to said base member, when said support member is squeezed said support member becomes unlocked and adjustable relative to said base member, said support member becoming locked relative to said base member when said support member is released; and further including a plurality of positioners associated with said second mating portion for meshing with said first mating portion in one of a plurality of upright positions relative to said base member;

said plurality of positioners form spaced-apart guide ribs for cooperating with said first mating portion.

14. A gun rest comprising:

a base member having a first mating portion;

a support member having a second mating portion which mates with said first mating portion to secure said support member to said base member, when said support member is squeezed said support member becomes unlocked and adjustable relative to said base member, said support member becoming locked relative to said base member when said support member is released; and further including a plurality of positioners associated with said second mating portion for meshing with said first mating portion in one of a plurality of upright positions relative to said base member;

said gun rest further including at least one locking member associated with said second mating portion for engaging with said first mating portion to lock said support member to said base member in said one upright position.

15. The gun rest claimed in claim 14, wherein said locking member includes a barb for engaging with said first mating portion.

16. The gun rest claimed in claim 14, further including a locking tab associated with said first mating portion for engaging with said locking member.

* * * * *